US009683409B2

(12) United States Patent
Marchand

(10) Patent No.: US 9,683,409 B2
(45) Date of Patent: Jun. 20, 2017

(54) PRESSURE COMPENSATION SYSTEM FOR A MOTOR BEARING ASSEMBLY

(71) Applicant: National Oilwell Varco, L.P., Houston, TX (US)

(72) Inventor: Nicholas Marchand, Edmonton, CA (US)

(73) Assignee: National Oilwell Varco, L.P., Houston, TX (US)

( * ) Notice: Subject to any disclaimer, the term of this patent is extended or adjusted under 35 U.S.C. 154(b) by 471 days.

(21) Appl. No.: 14/181,356

(22) Filed: Feb. 14, 2014

(65) Prior Publication Data

US 2014/0231143 A1 Aug. 21, 2014

Related U.S. Application Data

(60) Provisional application No. 61/765,164, filed on Feb. 15, 2013.

(51) Int. Cl.
*E21B 4/02* (2006.01)
*E21B 4/00* (2006.01)

(52) U.S. Cl.
CPC ..... *E21B 4/02* (2013.01); *E21B 4/003* (2013.01)

(58) Field of Classification Search
CPC .. E21B 4/003; E21B 4/02; F03B 13/02; F04B 53/14; F16N 9/02
See application file for complete search history.

(56) References Cited

U.S. PATENT DOCUMENTS

| | | | | |
|---|---|---|---|---|
| 3,298,441 | A * | 1/1967 | Young | E21B 33/128 166/179 |
| 5,248,204 | A * | 9/1993 | Livingston | E21B 4/003 175/107 |
| 5,377,771 | A * | 1/1995 | Wenzel | E21B 4/003 175/107 |
| 6,250,806 | B1 * | 6/2001 | Beshoory | E21B 4/003 175/107 |
| 6,361,217 | B1 * | 3/2002 | Beasley | E21B 4/003 384/121 |
| 6,439,866 | B1 * | 8/2002 | Farkas | E21B 4/003 175/107 |
| 6,561,290 | B2 * | 5/2003 | Blair | E21B 4/003 175/107 |
| 6,827,160 | B2 * | 12/2004 | Blair | E21B 4/003 175/107 |
| 8,181,720 | B2 * | 5/2012 | Prill | E21B 4/003 175/107 |
| 8,511,906 | B2 * | 8/2013 | Marchand | E21B 4/003 384/368 |
| 8,915,312 | B2 * | 12/2014 | Villarreal | E21B 4/003 175/101 |
| 9,163,457 | B2 * | 10/2015 | Marchand | E21B 4/02 |
| 2014/0166365 | A1 * | 6/2014 | Fagg | E21B 17/073 175/57 |

* cited by examiner

*Primary Examiner* — Nicole Coy
(74) *Attorney, Agent, or Firm* — Conley Rose, P.C.

(57) ABSTRACT

In an oil-sealed bearing assembly in the bearing section of a mud motor, in which a mandrel is rotatably disposed within a cylindrical housing, a cylindrical sleeve is disposed coaxially within the mandrel with the sleeve being non-rotatably mounted to an inner surface of the mandrel, thereby forming an annular piston chamber forming part of a generally annular oil reservoir. An annular piston is axially movable within the piston chamber without rotation relative to either the mandrel or the sleeve.

19 Claims, 3 Drawing Sheets

PRESSURE COMPENSATION SYSTEM FOR A MOTOR BEARING ASSEMBLY

CROSS-REFERENCE TO RELATED APPLICATIONS

This application claims benefit of U.S. provisional patent application Ser. No. 61/765,164, filed Feb. 15, 2013, and entitled "Pressure Compensation System for a Motor Bearing Assembly," which is hereby incorporated by reference in its entirety.

STATEMENT REGARDING FEDERALLY SPONSORED RESEARCH OR DEVELOPMENT

Not applicable.

BACKGROUND

The disclosure relates generally to bearing assemblies for mud motors used in drilling of oil, gas, and water wells. More particularly, the disclosure relates to pressure compensation systems for oil-sealed bearing assemblies.

It has become increasingly common and desirable in the oil and gas industry to use "directional drilling" techniques to drill horizontal and other non-vertical wellbores, to facilitate more efficient access to and production from larger regions of subsurface hydrocarbon-bearing formations than would be possible using only vertical wellbores. In directional drilling, specialized drill string components and "bottomhole assemblies" (BHAs) are used to induce, monitor, and control deviations in the path of the drill bit, so as to produce a wellbore of desired non-vertical configuration.

Directional drilling is typically carried out using a "downhole motor" (alternatively referred to as a "mud motor") incorporated into the drill string immediately above the drill bit. A typical mud motor includes several primary components, as follows (in order, starting from the top of the motor assembly): a top sub adapted to facilitate connection to the lower end of a drill string ("sub" being the common general term in the oil and gas industry for any small or secondary drill string component); a power section comprising a positive displacement motor of well-known type, with a helically-vaned rotor eccentrically rotatable within a stator section; a drive shaft enclosed within a drive shaft housing, with the upper end of the drive shaft being operably connected to the rotor of the power section; and a bearing section comprising a cylindrical mandrel coaxially and rotatably disposed within a cylindrical housing, with an upper end coupled to the lower end of the drive shaft, and a lower end adapted for connection to a drill bit. The mandrel is rotated by the drive shaft, which rotates in response to the flow of drilling fluid under pressure through the power section. The mandrel rotates relative to the cylindrical housing, which is connected to the drill string.

Directional drilling allows the well to be drilled out at an angle. A bent housing motor is used to form a curved well path. The bent housing is usually located above the bearing section and below the power section. The distance from the bit to the location of the bend in the housing is the bit-to-bend distance. A shorter bit-to-bend distance reduces the bit offset, allowing for a higher build rate for a given bend size. A shorter bit-to-bend distance also reduces the moment arm, reducing the bend stress at the bend. Thus, a shorter bit-to-bend makes the motor easier to orient and control and allows a sharper hole curvature to be made or the same curvature can be achieved with less bend and, subsequently, less overall stress in the motor. It is desirable to minimize the bit-to-bend when drilling non-straight wellbores.

In drilling processes using a mud motor, drilling fluid is circulated under pressure through the drill string and back up to the surface as in conventional drilling methods. However, the pressurized drilling fluid exiting the lower end of the drill pipe is diverted through the power section of the mud motor to generate power to rotate the drill bit.

The bearing section must permit relative rotation between the mandrel and the housing, while also transferring axial thrust loads between the mandrel and the housing. Axial thrust loads arise in two drilling operational modes: "on-bottom" loading, and "off-bottom" loading. On-bottom loading corresponds to the operational mode during which the drill bit is boring into a subsurface formation under vertical load from the weight of the drill string, which in turn is in compression; in other words, the drill bit is on the bottom of the wellbore. Off-bottom loading corresponds to operational modes during which the drill bit is raised off the bottom of the wellbore and the drill string is in tension (i.e., when the bit is off the bottom of the wellbore and is hanging from the drill string, such as when the drill string is being "tripped" out of the wellbore, or when the wellbore is being reamed in the uphole direction). This condition occurs, for instance, when the drill string is being pulled out of the wellbore, putting the drill string into tension due to the weight of drill string components. Tension loads across the bearing section housing and mandrel are also induced when circulating drilling fluid with the drill bit off bottom, due to the pressure drop across the drill bit and bearing assembly.

Bearings contained in the bearing section of a mud motor may be either oil-lubricated or mud-lubricated. In an oil-sealed bearing assembly, the bearings are located within an oil-filled reservoir in an annular region between the mandrel and the housing, with the reservoir being defined by the inner surfaces of the housing and the outer surface of the mandrel, and by sealing elements at each end of the reservoir. Because of the relative rotation between the mandrel and the housing, these sealing elements must include rotary seals.

Mud motor bearing sections also include multiple radial bearings to maintain coaxial alignment between the mandrel and the bearing housing. In an oil-sealed assembly, the radial bearings can be provided in the form of bushings disposed in an annular space between the inner surface of the housing and the outer surface of the mandrel.

An oil-sealed bearing assembly must incorporate pressure compensation means, whereby the volume of the annular oil reservoir is automatically adjusted to compensate for changes in oil volume due to temperature changes. In addition, certain types of elastomeric rotary seals (such as KALSI SEALS®) are designed to slowly pump oil underneath the seal interface, and this causes a gradual reduction in oil volume which also must be compensated for. For optimum performance of the rotary seal, it is ideal for the sealing surface of the mandrel to be as wear-resistant as possible, while having a very fine surface finish.

A common method of providing pressure compensation in an oil-sealed bearing assembly uses an annularly-configured piston disposed within an annular region (or "piston chamber") between the housing and mandrel. The outer diameter (OD) of the piston is sealed against the inner bore of the housing (by means of one or more sliding seals, such as O-rings), and also may incorporate anti-rotation seals to ensure that the piston does not rotate relative to the housing. The inner diameter (ID) of the piston is sealed against the mandrel by means of a rotary seal, which rotates relative to the mandrel during operation, and also slides axially along the mandrel as the piston moves. The rotary seal and sliding seals associated with the piston thus define the upper end of the oil reservoir within the bearing assembly.

A sufficient length of the mandrel below the piston's initial position must remain uninterrupted to accommodate the piston travel that will occur as oil volume varies over time (whether due to temperature change or oil loss). The housing bore must be similarly uninterrupted along this length, forming a cylindrical oil reservoir. Therefore, a significant length of the mandrel and housing in a conventional oil-sealed mud motor bearing section is dedicated to the pressure-compensating piston.

For optimum performance of the rotary seal, it is ideal for the sealing surface of the mandrel to be as wear-resistant as possible, with a very fine surface finish. This is typically provided through the use of a surface treatment such as an abrasion-resistant, diamond-ground coating. To accommodate axial translation of the piston within the piston chamber, the surface treatment of the mandrel needs to be provided over a length corresponding to at least the range of travel of the piston's rotary seal, and preferably the full length of the piston chamber.

SUMMARY

In one embodiment, a mud motor bearing section having an upper end and a lower end includes a mandrel rotatably and coaxially disposed within a cylindrical housing having a longitudinal axis, the mandrel has an outer surface, and the housing has an inner surface. In addition, the bearing section also includes a cylindrical sleeve having an outer cylindrical surface, the sleeve being disposed within an inner cylindrical surface of the mandrel, the sleeve being coupled to the mandrel to form an annular piston chamber between the outer surface of the sleeve and the inner cylindrical surface of the mandrel. Moreover, the bearing section also includes an annular piston non-rotatingly disposed within the piston chamber, wherein the piston is adapted to move axially within the piston chamber, with the piston having an inner face sealingly engaging the outer surface of the sleeve, and an outer face sealingly engaging the inner cylindrical surface of the mandrel. In some embodiments, the bearing section may include an annular oil reservoir having a first portion radially disposed between the outer surface of the mandrel and the inner surface of the housing in fluid communication with a second portion radially disposed between the outer surface of the sleeve and the inner surface of the mandrel. In addition, the first portion extends axially between an upper rotary seal and a lower rotary seal, the upper rotary seal and the lower rotary seal each being radially disposed between the mandrel and housing. Further, the second portion extends axially between the piston and an end of the cylindrical sleeve. Moreover, wherein a portion of the oil reservoir defines an annular bearing chamber.

In another aspect, a bearing section for a mud motor having an upper end and a lower end includes a mandrel rotatably and coaxially disposed within a cylindrical housing having a longitudinal axis, the mandrel having an outer surface, and the housing having an inner surface. In addition, the bearing section also includes a cylindrical sleeve having an outer cylindrical surface, the sleeve being disposed within an inner cylindrical surface of the mandrel, with the sleeve mounted to the mandrel to form an annular piston chamber between the outer surface of the sleeve and the inner cylindrical surface of the mandrel. Moreover, the bearing section further includes an annularly-configured piston disposed within the piston chamber. Further, the bearing section also includes an annular oil reservoir having a first portion bounded by the outer surface of the mandrel and the inner surface of the housing, and a second portion in the annular piston chamber, wherein the first portion is fluidly coupled to the second portion by a port through the mandrel.

In one embodiment of a method for providing a shortened mud motor bearing section, the method includes rotatably and coaxially disposing a mandrel in a cylindrical housing, mounting a cylindrical sleeve within the mandrel. In addition, the method includes forming an annular piston chamber between an outer surface of the sleeve and an inner surface of the mandrel, and disposing an annular piston in the annular piston chamber for axial movement therein.

Embodiments described herein comprise a combination of features and advantages intended to address various shortcomings associated with certain prior devices, systems, and methods. The foregoing has outlined rather broadly the features and technical advantages of the disclosure such that the detailed description of the disclosure that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the disclosure. It should also be realized by those skilled in the art that such equivalent constructions do not depart from the spirit and scope of the disclosure as set forth in the appended claims.

BRIEF DESCRIPTION OF THE DRAWINGS

For a detailed description of the disclosed embodiments, reference will now be made to the accompanying drawings, in which numerical references denote like parts, and in which.

DETAILED DESCRIPTION

Figure 1:
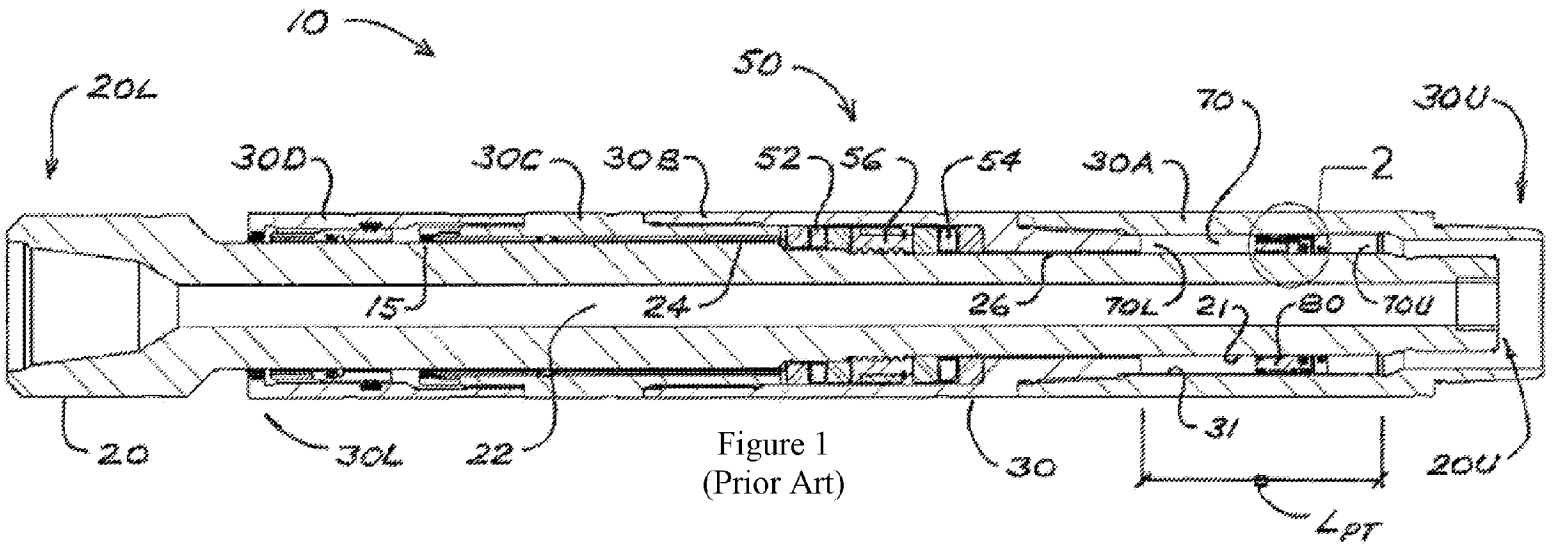
Figure 1 (Prior Art)
FIG. 1 is a longitudinal cross-section through the bearing section of a prior art mud motor.

The following discussion is directed to various embodiments of the disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Any use of any form of the terms "connect," "mount," "engage," "couple," "attach," or any other term describing an interaction between elements is not meant to limit the interaction to direct interaction between the subject elements, and may also include indirect interaction between the elements such as through secondary or intermediary structure. Relational terms such as "parallel," "perpendicular," "coincident," "intersecting," and "equidistant" are not intended to denote or require absolute mathematical or geometrical precision. Accordingly, such terms are to be understood as denoting or requiring substantial precision only (e.g., "substantially parallel") unless the context clearly requires otherwise.

Figure 2:
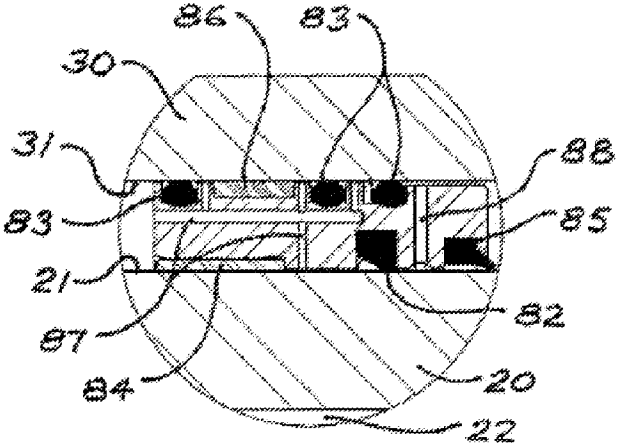
Figure 2 (Prior Art)
FIG. 2 is an enlarged detail of the pressure-compensating piston of the prior art bearing section shown in FIG. 1.

FIG. 1 illustrates a typical oil-sealed bearing assembly in the bearing section 10 of a prior art mud motor, and FIG. 2 illustrates the pressure-compensating piston 80 of the prior art assembly. Bearing section 10 includes a mandrel 20 having an upper end 20U, a lower end 20L, and a central bore 22 through which drilling fluid can be pumped down to a drill bit (not shown) connected directly or indirectly to lower end 20L of mandrel 20. Mandrel 20 is coaxially and rotatably disposed within a cylindrical housing 30, which typically will be made up of multiple subsections (such as 30A, 30B, 30C, 30D in FIG. 1) threaded together. Housing 30 has an upper end 30U adapted for connection to the lower end of the drive shaft housing (not shown) of the mud motor, and a lower end 30L (through which lower end 20L of mandrel 20 projects). Upper end 20U of mandrel 20 is adapted for connection to the drive shaft (not shown) of the mud motor, such that the drive shaft will rotate mandrel 20 within and relative to housing 30. In the illustrated assembly, a lower rotary seal 15 is provided between mandrel 20 and housing 30 near the lower end of subsection 30C of housing 30.

In the illustrated prior art bearing section 10, a bearing assembly 50 is disposed within an annular bearing chamber between mandrel 20 and housing 30, at roughly mid-length of bearing section 10. For illustration purposes, bearing assembly 50 is shown as comprising a lower bearing 52 (with associated bearing races) for resisting off-bottom thrust loads; an upper bearing 54 (with associated bearing races) for resisting on-bottom thrust loads; and a split ring 56 mounted to mandrel 20 to provide load-transferring shoulders for transferring thrust loads to bearings 52 and 54. However, the structural and operational details of bearing assembly 50 are not directly relevant to embodiments of the present disclosure, and therefore are not described in further detail in this patent specification. Between bearing assembly 50 and lower end 30L of housing 30, a lower radial bearing (shown in the form of a lower bushing 24) is provided in an annular space between mandrel 20 and housing 30, to provide radial support to mandrel 20 as it rotates within housing 30.

Referring now to FIGS. 1 and 2, in a region above bearing assembly 50, a cylindrical piston chamber 70 is formed between the outer cylindrical surface 21 of mandrel 20 and the inner cylindrical surface 31 of housing 30. An annular piston 80 is disposed within cylindrical piston chamber 70, and is axially and bi-directionally movable therein. Piston 80 typically is non-rotatable relative to housing 30, while upper end 20U of mandrel 20 rotates relative to piston 80 and housing 30. Accordingly, piston 80 carries a rotary seal 82 to seal piston 80 relative to mandrel 20 as piston 80 moves axially within cylindrical piston chamber 70 and as mandrel 20 rotates within and relative to piston 80. The upper end of piston 80 also carries a wiper seal 85 which engages outer surface 21 of mandrel 20. Piston 80 is also shown with a bushing 84 engaging outer surface 21 of mandrel 20, and multiple sliding seals 83 engaging inner surface 31 of housing 30. Optionally, piston 80 may also have an outer bushing 86 engaging inner surface 31 of housing 30, as shown in FIG. 2. A generally annular oil reservoir is thus formed between lower rotary seal 15, piston 80 (with its associated seals), outer surface 21 of mandrel 20, and inner surface 31 of housing 30, and includes piston chamber 70 and the bearing chamber associated with bearing assembly 50. As seen in FIG. 2, piston 80 may have one or more oil channels 87 and mud channels 88 for distributing oil and drilling mud (respectively) between the inner and outer surfaces of piston 80, to prevent hydraulic pressure locking between pairs of seals.

Piston chamber 70 has an upper end 70U and a lower end 70L, defining a piston travel length $L_{PT}$ through which piston 80 can travel. An upper radial bearing (shown in the form of an upper bushing 26) is provided in an annular space between mandrel 20 and housing 30 in a region between bearing assembly 50 and lower end 70L of piston chamber 70. However, a portion of mandrel 20 having a length corresponding to piston travel length $L_{PT}$ has no radial support (except to the variable extent of any radial support provided by piston 80).

Figure 3:
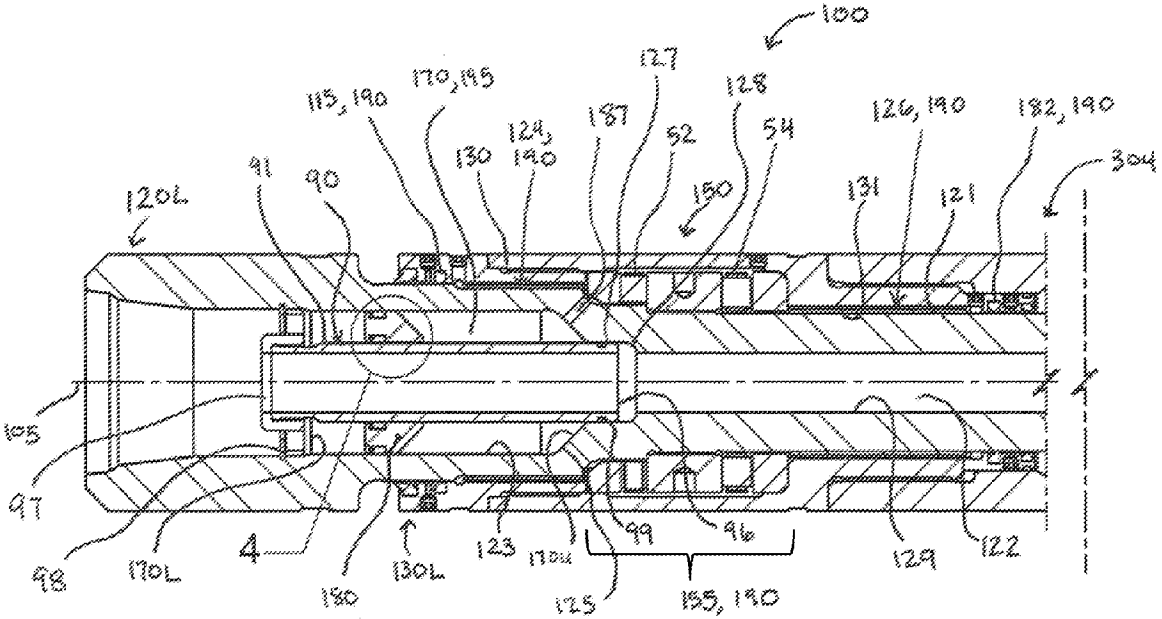
FIG. 3 is a longitudinal cross-section through the bearing section of a mud motor incorporating a pressure compensation assembly in accordance with an embodiment of the present disclosure.

FIG. 3 illustrates a mud motor bearing section 100 incorporating a pressure compensation system in accordance with principles disclosed herein. Bearing section 100 has a central axis 105 and includes a mandrel 120, a housing 130, and a lower rotary seal 115. Bearing section 100 incorporates a bearing assembly 150 disposed within an annular bearing chamber 155 between mandrel 120 and housing 130, at an intermediate location along bearing section 100, generally as described and illustrated with reference to prior art bearing section 10 in FIG. 1. Bearing assembly 150 is shown as being similar to bearing assembly 50 in FIG. 1, but could be of a different configuration in other embodiments. As in prior art bearing section 10, a lower bushing 124 is provided in the annular space between mandrel 120 and housing 130 between bearing assembly 150 and lower end 130L of housing 130, to provide radial support to mandrel 120 as it rotates within housing 130. An upper rotary seal 182 is located within housing 130 (toward upper end 130U thereof) to seal housing 130 relative to mandrel 120 as mandrel 120 rotates within and relative to housing 130.

Figure 5:
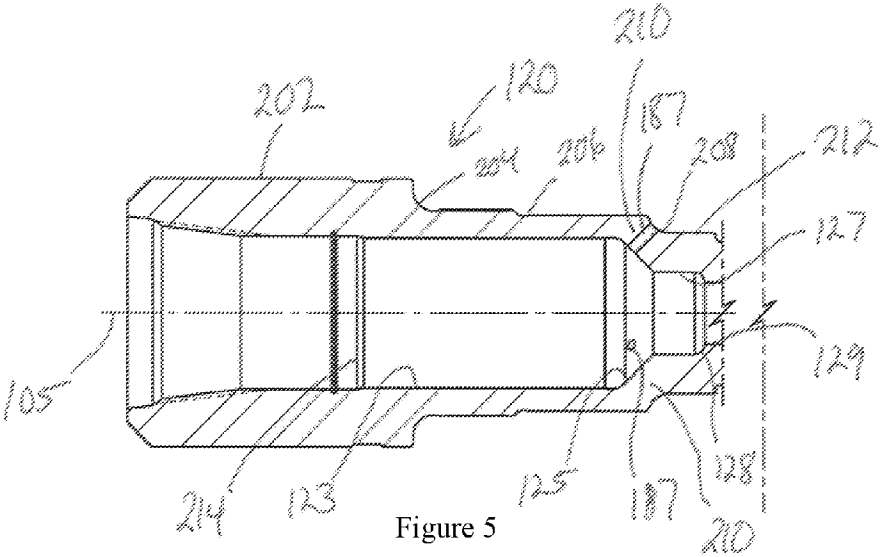
FIG. 5 is an isolated view of a mandrel of the mud motor bearing section shown in FIG. 3.

Referring additionally to FIG. 5, mandrel 120 comprises an inner cylindrical surface 123 having a tapered surface 125 that tapers down to a first reduced diameter cylindrical surface 127, which has a curved surface 128 that curves or tapers down to a second reduced diameter cylindrical surface 129. The second reduced diameter cylindrical surface 129 also forms the central bore 122 of the mandrel 120 for the passage of fluids or other devices through the bearing section 100. The outer surface 121 of the mandrel 120 includes an outer cylindrical surface 202, a first curved or tapered surface 204, a first reduced diameter cylindrical surface 206, a second curved or tapered surface 208, and a second reduced diameter cylindrical surface 212. The tapered surfaces 125, 208 form a shoulder or neck 210 in the mandrel 120. One or more oil channels or ports 187 extend through the neck 210 and the tapered surfaces 125, 208 of mandrel 120 between piston chamber 170 and bearing assembly chamber 55 to allow fluid flow therebetween. The upper end 96 of sleeve 90 sealingly engages the first reduced diameter cylindrical surface 127 and the curved surface 128 of mandrel 120 by any suitably secure means, such as by means of an O-ring represented in FIG. 3 by reference numeral 99.

Figure 6:
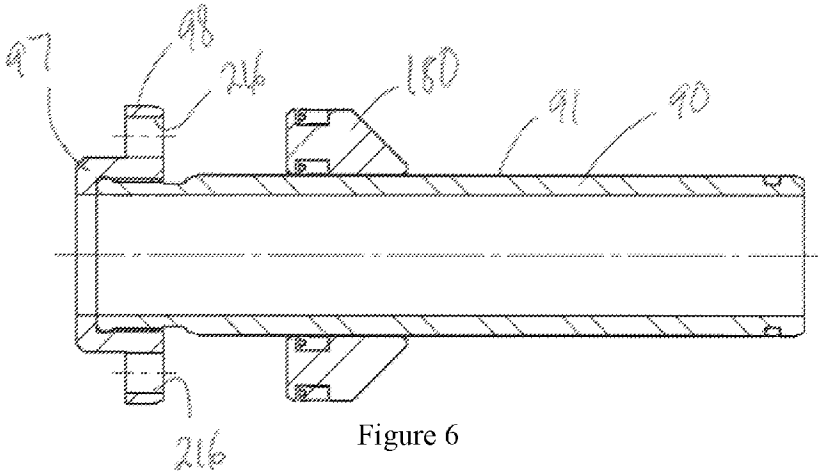
FIG. 6 is an isolated view of a sleeve, retainer, and annular piston assembly of the mud motor bearing section shown in FIG. 3.

Referring now to FIGS. 3 and 6, at the lower end of and radially overlapping the bearing assembly 150, a cylindrical sleeve 90 is mounted inside, and coaxial with mandrel 120, such that an annular piston chamber 170 (with upper end 170U and lower end 170L) is formed between the outer cylindrical surface 91 of sleeve 90 and the first reduced diameter cylindrical surface 127 of mandrel 120. In general, sleeve 90 may be mounted to mandrel 120 in any suitable way known in the art. By way of non-limiting example, the lower end of sleeve 90 may be threadedly engaged to a centralizer 97 which is coupled to and supported by a retaining ring 98. The retaining ring 98 may be received in and supported by a receptacle 214 inside the mandrel 120 (FIG. 5). The retaining ring 98 may include a passage or passages 216.

An upper bushing 126, as shown in FIG. 3, is provided in an annular space between mandrel 120 and housing 130 in a region between bearing assembly 150 and upper rotary seal 182, to facilitate rotation of mandrel 120 within housing 130 (optionally with lubrication channels provided in the inner surface 131 of housing 130 to allow passage of oil to lubricate bushing 126 and upper rotary seal 182).

Figure 4:
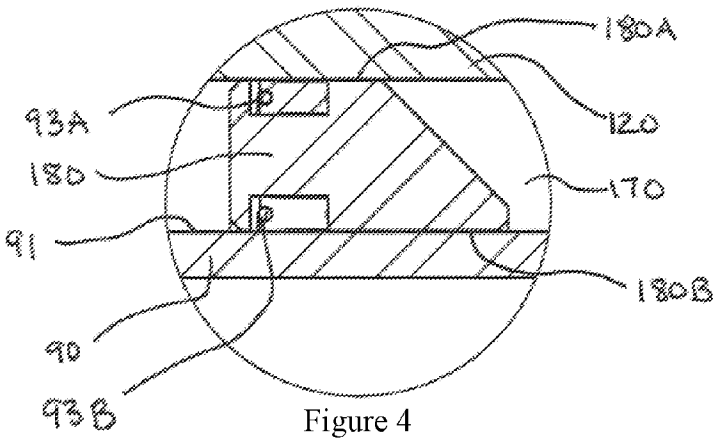
FIG. 4 is an enlarged detail of the pressure compensation assembly of the bearing section shown in FIG. 3.

Referring now to FIGS. 3, 4, and 6, an annular pressure-balancing piston 180 is disposed within piston chamber 170, and is axially and bi-directionally movable therein. Piston 180 has an outer face 180A for sliding engagement with inner surface 23 of mandrel 20 in conjunction with an outer seal 93A, and an inner face 180B for sliding engagement with outer surface 91 of sleeve 90 in conjunction with an inner seal 93B. In some embodiments, piston 180 does not rotate relative to both mandrel 120 and sleeve 90; accordingly, outer seal 93A and inner seal 93B can be sliding seals (such as O-rings or lip seals) rather than rotary seals.

An annular oil reservoir is formed comprising two portions in fluid communication through the oil channel or port 187. The first portion 190 is formed between the outer surface 121 of mandrel 120 and the inner surface 131 of housing 130, and extends axially from lower rotary seal 115 to upper rotary seal 182, and includes the bearing chamber 155 associated with bearing assembly 150. The second portion 195 is formed within piston chamber 170, between piston 180 (with sliding seals 93A and 93B), outer surface 91 of sleeve 90, inner surface 123 of mandrel 120, and O-ring 99. Oil channel 187 fluidly connects first and second portions 190, 195 of the oil reservoir. The piston 180 is axially movable within the piston chamber 170 in response to variations in the volume of oil in the reservoir 190, 195.

Because piston 180 does not rotate relative to either mandrel 120 or sleeve 90, rotary seals and anti-rotation seals within piston 180 are unnecessary. Unlike the upper rotary seal 82 in the prior art assembly of FIGS. 1 and 2, which translates along mandrel 20 during operation of piston 80, the upper rotary seal 182 of the present disclosure of FIGS. 3 and 4 is housed in a fixed location within housing 130, such that it does not translate during operation of piston 180. Therefore, the length of outer surface 121 of mandrel 120 requiring wear-resistant surface treatment for rotary seal 182 can be reduced or kept to a minimum, with resultant cost savings. In addition, and unlike in prior art piston 80 in FIG. 2, piston 180 can use a single outer seal 93A and a single inner seal 93B as shown in FIGS. 3, 4, and 6. Further, hydraulic pressure locking is not an issue and it is, thus, unnecessary for piston 180 to have oil channels 87 and mud channels 88 as in the piston 80 of the prior art (FIG. 1).

The overall length of the bearing section 100 of the present disclosure is reduced over that of the prior art. By using the sleeve 90 in conjunction with the piston 180, the piston chamber 170 can be located in the lower end 120L of mandrel 120 such that the piston chamber 170 is in proximity to and in fluid communication with the bearing chamber 150, thereby allowing the overall length of the bearing section 100 to be reduced. Thus, a shorter bit-to-bend distance can be achieved, allowing the mud motor to produce sharper hole curvatures or the same curvatures as previously produced, but with reduced stress on the mud motor. The capacity of the piston chamber 170 allows for equivalent mud motor run times as in prior art designs. Thus, the present disclosed embodiments allow for a shortened bit-to-bend distance without compromising the operating life of the mud motor.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A mud motor bearing section having an upper end and a lower end, the bearing section comprising:

a mandrel rotatably and coaxially disposed within a cylindrical housing having a longitudinal axis, wherein the mandrel comprises an inner cylindrical surface, an outer surface, and a port extending between the inner cylindrical surface and the outer surface, and wherein the housing comprises an inner surface;

a cylindrical sleeve having an outer cylindrical surface, the sleeve being disposed within the inner cylindrical surface of the mandrel, the sleeve being coupled to the mandrel to form an annular piston chamber between the outer surface of the sleeve and the inner cylindrical surface of the mandrel; and an annular piston non-rotatingly disposed within the piston chamber, wherein the piston is adapted to move axially within the piston chamber, with the piston having an inner face sealingly engaging the outer surface of the sleeve, and an outer face sealingly engaging the inner cylindrical surface of the mandrel, wherein an end of the sleeve sealingly engages the inner cylindrical surface of the mandrel.

2. The mud motor bearing section of claim 1, further comprising:

an annular oil reservoir having a first portion radially disposed between the outer surface of the mandrel and the inner surface of the housing in fluid communication with a second portion radially disposed between the outer surface of the sleeve and the inner surface of the mandrel;

wherein the first portion extends axially between an upper rotary seal and a lower rotary seal, the upper rotary seal and the lower rotary seal each being radially disposed between the mandrel and housing;

wherein the second portion extends axially between the piston and an end of the cylindrical sleeve;

wherein a portion of the oil reservoir defines an annular bearing chamber.

3. The mud motor bearing section of claim 2, wherein the sleeve has a centralizer projecting radially outward from the sleeve's outer cylindrical surface, the centralizer being adapted for connection to the mandrel.

4. The mud motor bearing section of claim 2, wherein one or more lubrication channels are formed in the mandrel and fluidly connect the piston chamber and the annular bearing chamber.

5. The mud motor bearing section of claim 2, wherein the inner face of the piston carries a non-rotary seal for sealing engagement with the outer surface of the sleeve.

6. The mud motor bearing section of claim 2, wherein the outer face of the piston carries a non-rotary seal for sealing engagement with the inner surface of the mandrel.

7. The bearing section of claim 1, wherein fluid communication between the piston chamber and a central bore of the sleeve is restricted.

8. A bearing section for a mud motor having an upper end and a lower end, the bearing section comprising:

a mandrel rotatably and coaxially disposed within a cylindrical housing having a longitudinal axis, the mandrel having an outer surface, and the housing having an inner surface;

a cylindrical sleeve having an outer cylindrical surface, the sleeve being disposed within an inner cylindrical surface of the mandrel, with the sleeve mounted to the mandrel to form an annular piston chamber between the outer surface of the sleeve and the inner cylindrical surface of the mandrel;

an annularly-configured piston disposed within the piston chamber; and an annular oil reservoir having a first portion bounded by the outer surface of the mandrel and the inner surface of the housing, and a second portion in the annular piston chamber, wherein the first portion is fluidly coupled to the second portion by a port of the mandrel.

9. The bearing section of claim 8, wherein the annular oil reservoir further comprises one or more channels connecting the first and second portions.

10. The bearing section of claim 8, wherein the upper rotary seal and the lower rotary seal are each radially disposed between the mandrel and housing.

11. The bearing section of claim 8, wherein a portion of the oil reservoir defines an annular bearing chamber.

12. The bearing section of claim 8, wherein the sleeve has a centralizer projecting radially outward from the sleeve's outer cylindrical surface, the centralizer being connected to the mandrel.

13. The bearing section of claim 8, wherein the inner face of the piston sealingly engages the outer surface of the sleeve by means of a non-rotary seal.

14. The bearing section of claim 8, wherein the outer face of the piston sealingly engages the inner surface of the mandrel by means of a non-rotary seal.

15. A method for providing a mud motor bearing section, the method comprising:

rotatably and coaxially disposing a mandrel in a cylindrical housing, wherein the mandrel is permitted to make a full rotation in the housing and comprises a port extending between inner and outer surfaces of the mandrel;

mounting a cylindrical sleeve within the mandrel;

forming an annular piston chamber between an outer surface of the sleeve and the inner surface of the mandrel; and disposing an annular piston in the annular piston chamber for axial movement therein;

wherein the mandrel is configured to couple with a drive shaft of a mud motor.

16. The method of claim 15, further comprising:

providing pressure compensation means comprising an annularly-configured piston disposed within and axially movable within the piston chamber, the piston having an inner face sealingly engageable with the outer surface of the sleeve and an outer face sealingly engageable with the inner surface of the mandrel.

17. The method of claim 15, further comprising:

fluidly coupling, through the mandrel, a first portion of an annular oil reservoir between the outer surface of the mandrel and the inner surface of the housing with a second portion of the annular oil reservoir in the annular piston chamber.

18. The method of claim 15, further comprising:

forming an annular reservoir having a first portion bounded by the outer surface of the mandrel and the inner surface of the housing and extending axially between upper and lower rotary seals, and a second portion bounded by the outer surface of the sleeve and the inner surface of the mandrel and extending axially between the piston and an end of the cylindrical sleeve.

19. The method of claim 15, wherein one or more lubrication channels are formed in the inner surface of the sleeve.

* * * * *